US007887138B2

(12) United States Patent
Chen

(10) Patent No.: US 7,887,138 B2
(45) Date of Patent: Feb. 15, 2011

(54) INTEGRALLY FORMED BASE ARRANGEMENT OF AN OFFICE CHAIR

(76) Inventor: Yung-Hua Chen, 1F, No. 2, Lane 157, Wa-an Street, Sinjhuang City, Taipei County 242 (TW)

( * ) Notice: Subject to any disclaimer, the term of this patent is extended or adjusted under 35 U.S.C. 154(b) by 113 days.

(21) Appl. No.: 12/320,299

(22) Filed: Jan. 23, 2009

(65) Prior Publication Data

US 2010/0187882 A1 Jul. 29, 2010

(51) Int. Cl.
*A47C 7/02* (2006.01)

(52) U.S. Cl. ..... 297/452.18; 297/452.24; 297/452.65

(58) Field of Classification Search ..... 297/452.18, 297/452.24, 452.65, 452.21, 344.21
See application file for complete search history.

(56) References Cited

U.S. PATENT DOCUMENTS 2,711,211 A * 6/1955 Tidcombe ..... 297/291
3,817,575 A * 6/1974 Bocksch et al. ..... 297/344.19
3,942,836 A * 3/1976 Baker ..... 297/451.1
4,361,357 A * 11/1982 Pollock ..... 297/297
4,662,681 A * 5/1987 Favaretto ..... 297/399
4,775,187 A * 10/1988 Herr ..... 297/378.14
D449,458 S * 10/2001 Malmanger et al. ..... D6/368
6,726,286 B2 * 4/2004 Stumpf et al. ..... 297/452.64
7,328,952 B2 * 2/2008 Guerrini ..... 297/344.21
7,654,616 B2 * 2/2010 Kinoshita et al. ..... 297/452.56
2006/0250019 A1 * 11/2006 Wu ..... 297/452.21
2007/0267911 A1 * 11/2007 Kinoshita et al. ..... 297/452.18

* cited by examiner

*Primary Examiner*—Sarah B McPartlin
(74) *Attorney, Agent, or Firm*—Rosenberg, Klein & Lee

(57) ABSTRACT

An integrally formed base arrangement of an office chair, and more particularly, a base arrangement integrally made by plastic material, comprising: a) a middle axle seat; b) a first U-shaped pivotal seat perpendicular to the middle axle seat; c) a claw member having a plurality of arched supporting arms extending in the shape of claws from the external rim of the middle axle seat upward; d) a base frame disposed at the top of the supporting arms of the claw member, an annular groove being positioned at the surface of the base frame; e) two second U-shaped pivotal seats symmetrically formed at both sides of the bottom of the base frame; and f) two hand rest supports extended from both sides of the base frame and the claw member outward, thereby creating a connection surface directed upward at the external end thereof. In this way, a convenient and rapid assembly of components of the office chair is ensured. Moreover, a stable structure is achieved.

6 Claims, 8 Drawing Sheets

INTEGRALLY FORMED BASE ARRANGEMENT OF AN OFFICE CHAIR

BACKGROUND OF THE INVENTION

1. Field of the Invention

The invention relates to an integrally formed base arrangement of an office chair, and more particularly to a base arrangement that is integrally formed by plastic material. Moreover, a convenient assembly and a stable structure are achieved.

2. Description of the Related Art

As shown in FIGS. 1 and 2, a conventional office chair 10 includes a foot portion 11, a seat portion 12, a back portion 13, and two hand rests 14. The seat portion 12 is the center of the whole chair since all of the other components are secured thereto.

The seat portion 12 of the conventional office chair 10 includes a metal plate 121, to which a seat pad 122 is attached. A seat support 123 is secured to the bottom thereof in a welding or screwing way for the connection of a middle tube 111 of the foot portion 11. Moreover, two connection seats 124 must be mounted at both sides of the metal plate 121 for the connection of the hand rests 14. Thus, the seat portion 12 is provided for the connection of all components, thereby leading to a complicated processing. Moreover, it does not provide an integrated appearance. Besides, the structural strength is reduced. In addition, the metal material is heavy and does not have the lightweight advantage. As a result, it requires further improvements.

SUMMARY OF THE INVENTION

An object of the invention is to provide a base arrangement of an office chair that is integrally formed. Moreover, the connection portions are also formed at the base arrangement for a convenient assembly and a stable structure.

Another object of the invention is to provide a base arrangement of an office chair whose weight is minimized while the strength of the whole structure is enhanced.

In order to achieve the above-mentioned object, an integrally formed base arrangement of an office chair in accordance with the invention includes:

a) a middle axle seat having a conic axle hole in longitudinal direction;

b) a first U-shaped pivotal seat perpendicular to the middle axle seat, the first U-shaped pivotal seat having an opening directed aback, the first U-shaped pivotal seat being provided with longitudinal grooves at both internal walls thereof, a locating portion being formed at the bottom of the longitudinal grooves;

c) a claw member having a plurality of arched supporting arms extending in the shape of claws from the external rim of the middle axle seat upward;

d) a base frame disposed at the top of the supporting arms of the claw member, an annular groove being positioned at the surface of the base frame;

e) two second U-shaped pivotal seats symmetrically formed at both sides of the bottom of the base frame with openings directed aback and positioned parallel to the first U-shaped pivotal seat, the second U-shaped pivotal seat having a through hole extended laterally at both sides thereof; and f) two hand rest supports extended from both sides of the base frame and the claw member outward, thereby creating a connection surface directed upward at the external end thereof.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
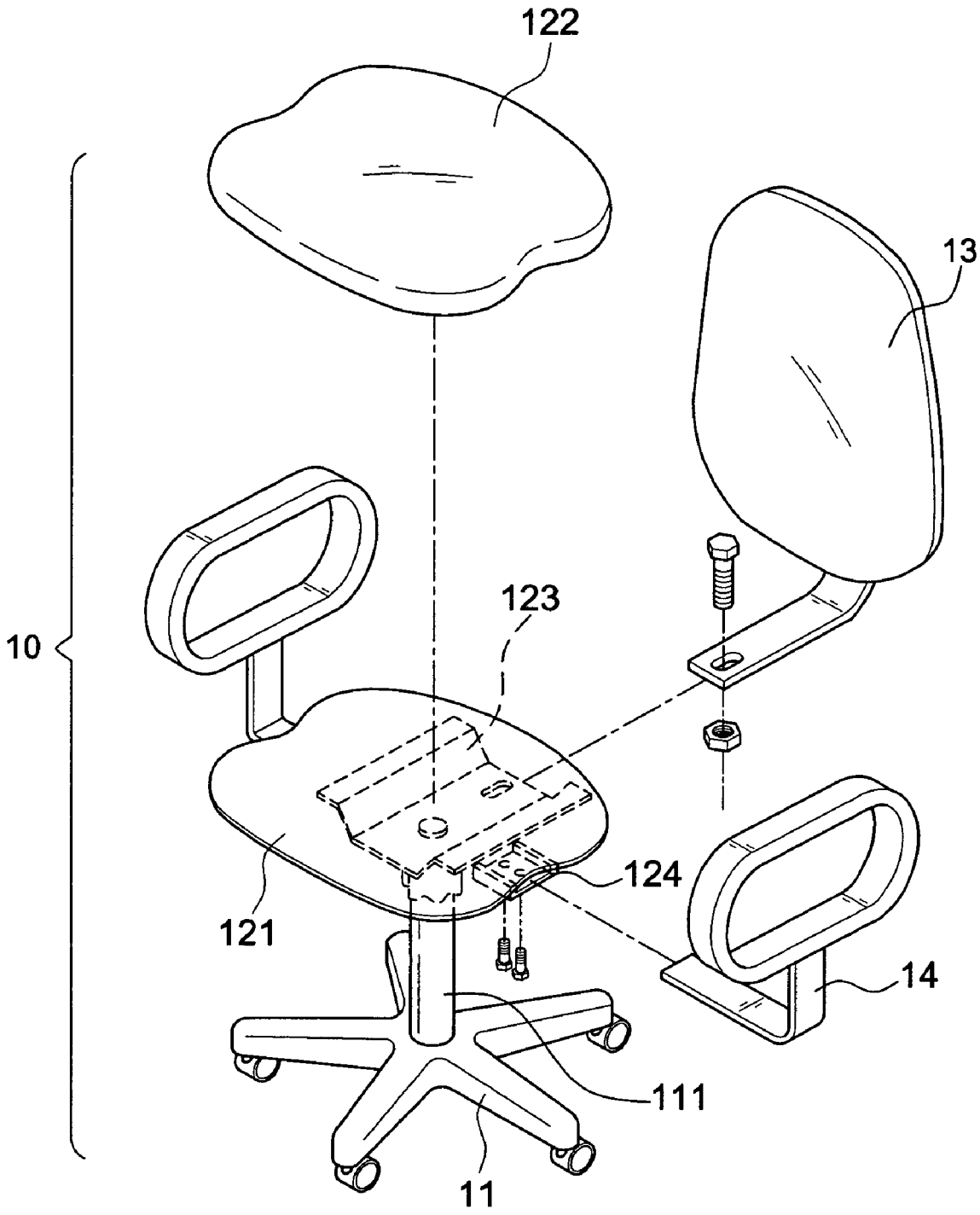
FIG.1 PRIOR ART
FIG. 1 is an exploded perspective view of a conventional office chair.
Figure 2:
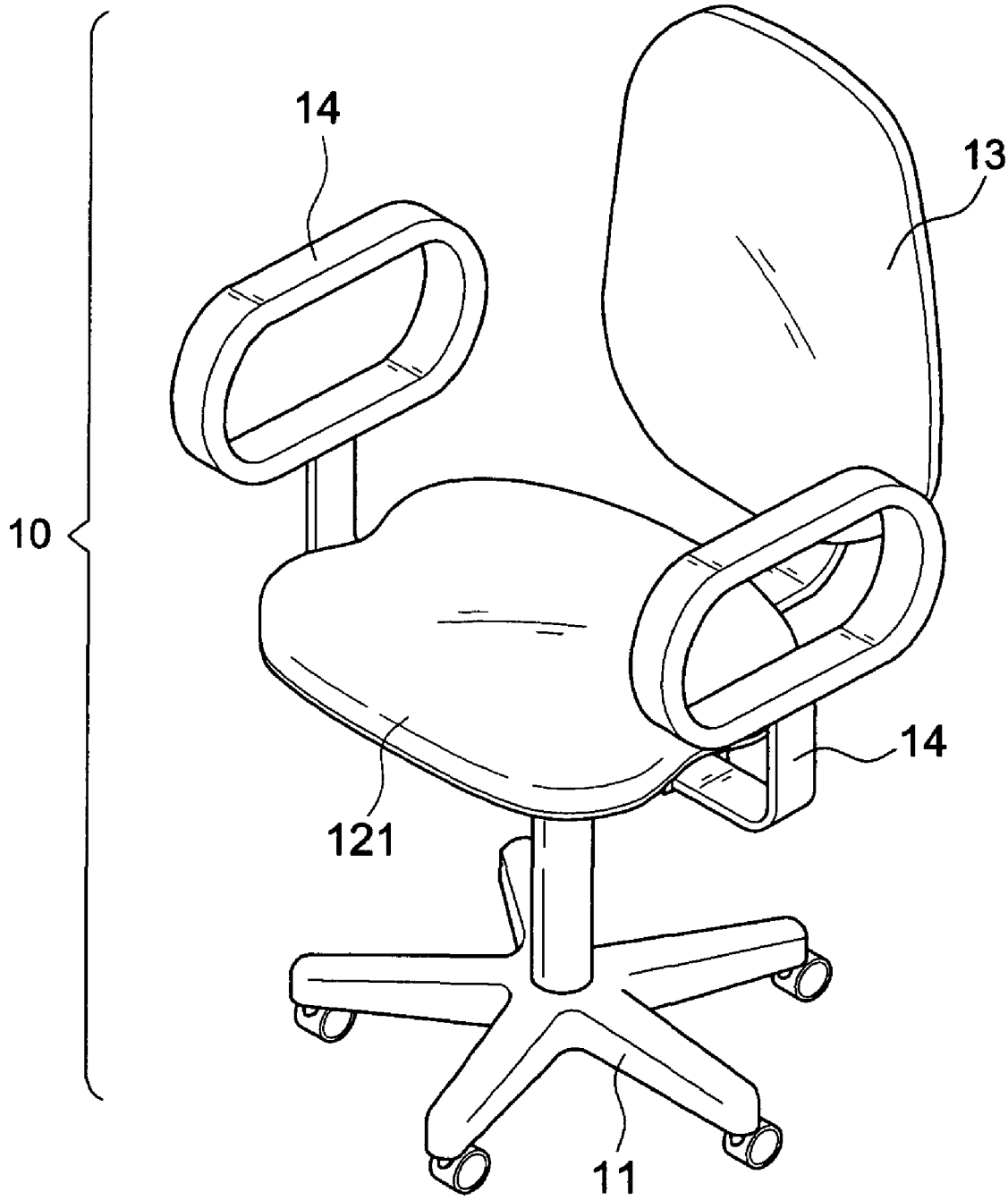
FIG.2 PRIOR ART
FIG. 2 is a perspective view of a conventional office chair.

First of all, referring to FIGS. 3 through 7, the whole base arrangement 20 in accordance with the invention is integrally made by plastic material. The base arrangement 20 includes a middle axle seat 30, a first U-shaped pivotal seat 40, a claw member 50, a base frame 60, two second U-shaped pivotal seats 70, and two hand rest supports 80.

The middle axle seat 30 includes a conic axle hole 31 in longitudinal direction. The conicity of the axle hole 31 tapers from bottom to top.

The first U-shaped pivotal seat 40 is perpendicular to the middle axle seat 30. Moreover, the first U-shaped pivotal seat 40 has an opening 41 directed aback. The first U-shaped pivotal seat 40 is provided with longitudinal grooves 42 at both internal walls thereof. A locating portion 43 is formed at the bottom of the longitudinal grooves 42. The longitudinal groove 42 is open at the top thereof, but it is not a through hole.

The claw member 50 includes a plurality of arched supporting arms 51 extending in the shape of claws from the external rim of the middle axle seat 30 upward. According to the embodiment, there are eight supporting arms 51, but should not be restricted thereto. Due to the consideration of the structural strength, the number of the supporting arms 51 must be enough. In taking the weight and the strength into account, the supporting arms 51 can be formed in a U-shaped body with an opening directed upwards. Moreover, strengthening ribs arranged in a cross manner are positioned within the U-shaped body.

The base frame 60 is disposed at the top of the supporting arms 51 of the claw member 50. An annular groove 61 is positioned at the surface of the base frame 60.

The second U-shaped pivotal seats 70 are symmetrically formed at both sides of the bottom of the base frame 60 with openings directed aback and positioned parallel to the first U-shaped pivotal seat 40. Moreover, the second U-shaped pivotal seat 70 includes a through hole 71 extended laterally at both sides thereof.

The hand rest supports 80 are extended from both sides of the base frame 60 and the claw member 50 outward, thereby creating an external shape of a connection surface 81 directed upward.

Figure 7:
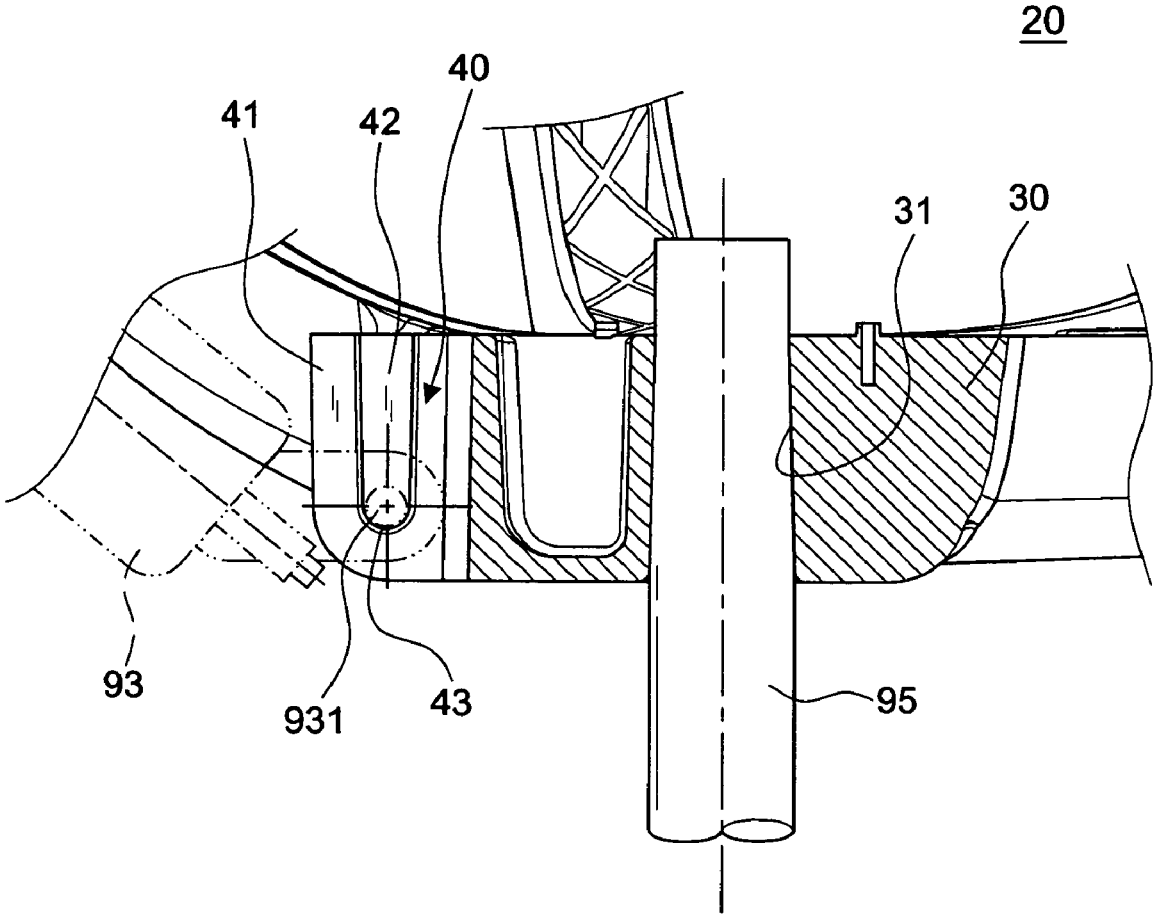
FIG. 7 is a partially enlarged view of the invention in FIG. 6, showing the connection with a middle tube and an elasticity adjuster.
Figure 8:
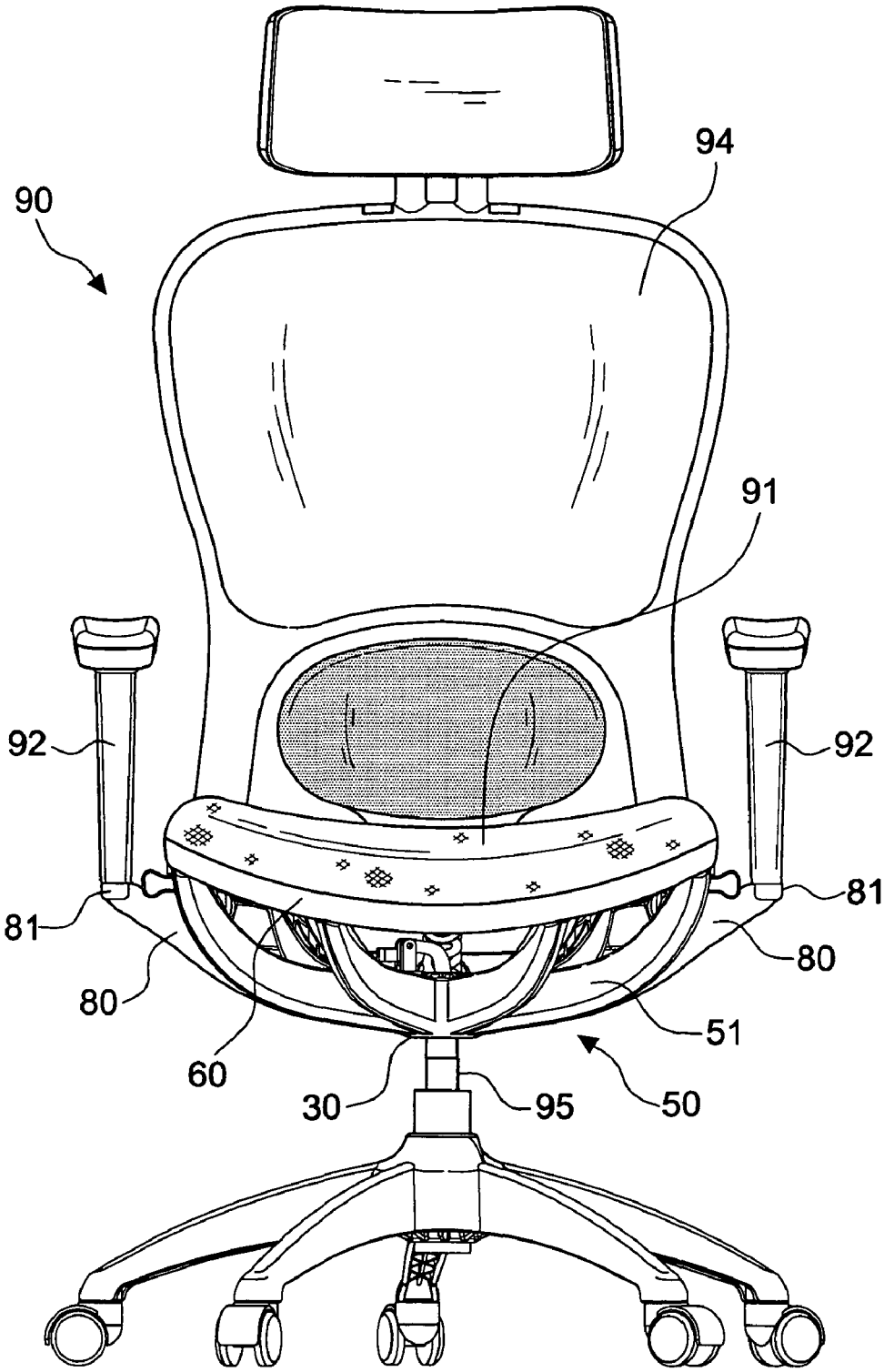
FIG. 8 is a front view of the application of the invention.
Figure 9:
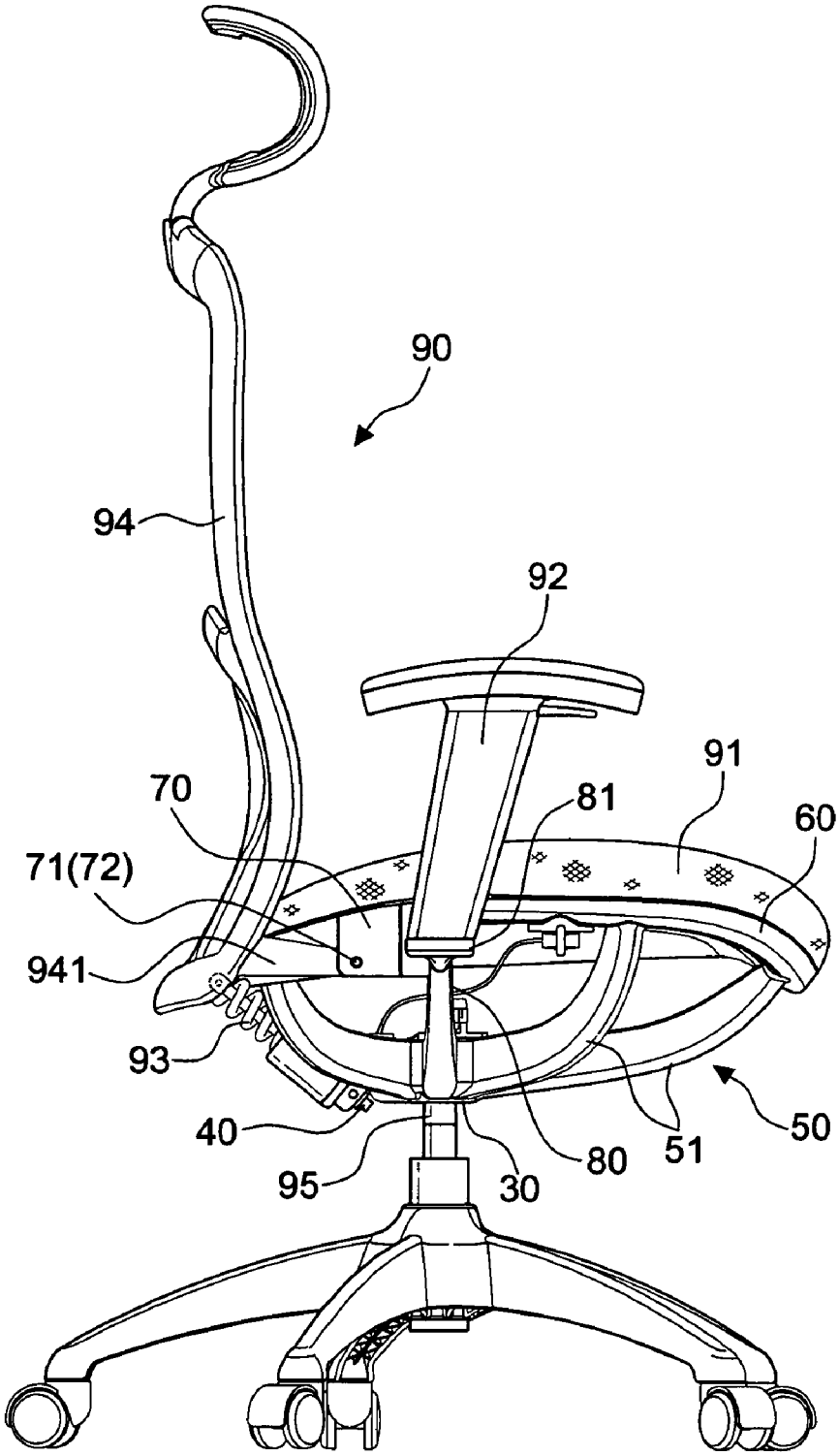
FIG. 9 is a side view of the application of the invention.

Referring to FIGS. 7 through 9, the axle hole 31 of the middle axle seat 30 of the base arrangement 20 is provided for the insertion of a foot seat middle tube 95 of an office chair 90 from bottom to top in place. After the top of the foot seat middle tube 95 projects from the axle hole 31, it may also be fixed by other locking elements (not shown). However, this is not the object of the invention so that no further descriptions thereto are given hereinafter. Moreover, the first U-shaped pivotal seat 40 is provided for the connection of the bottom of an elasticity adjuster 93 of the office chair 90. In addition, a lateral projection 931 at the bottom of the elasticity adjuster 93 is supported by the locating portion 43 at the bottom of the longitudinal grooves 42 in a pivotal manner. The elasticity adjuster 93 belongs to the prior art and is not the object of the invention so that no further descriptions thereto are given hereinafter. According to the embodiment of the invention, the longitudinal grooves 42 at both internal walls of the first U-shaped pivotal seat 40 is provided for an easy insertion of the lateral projection 931 of the elasticity adjuster 93 from top to bottom. Of course, the top of the longitudinal grooves 42 will be covered with locking elements (not shown) after the lateral projection 931 is inserted. No further descriptions thereto are given hereinafter.

Figure 6:
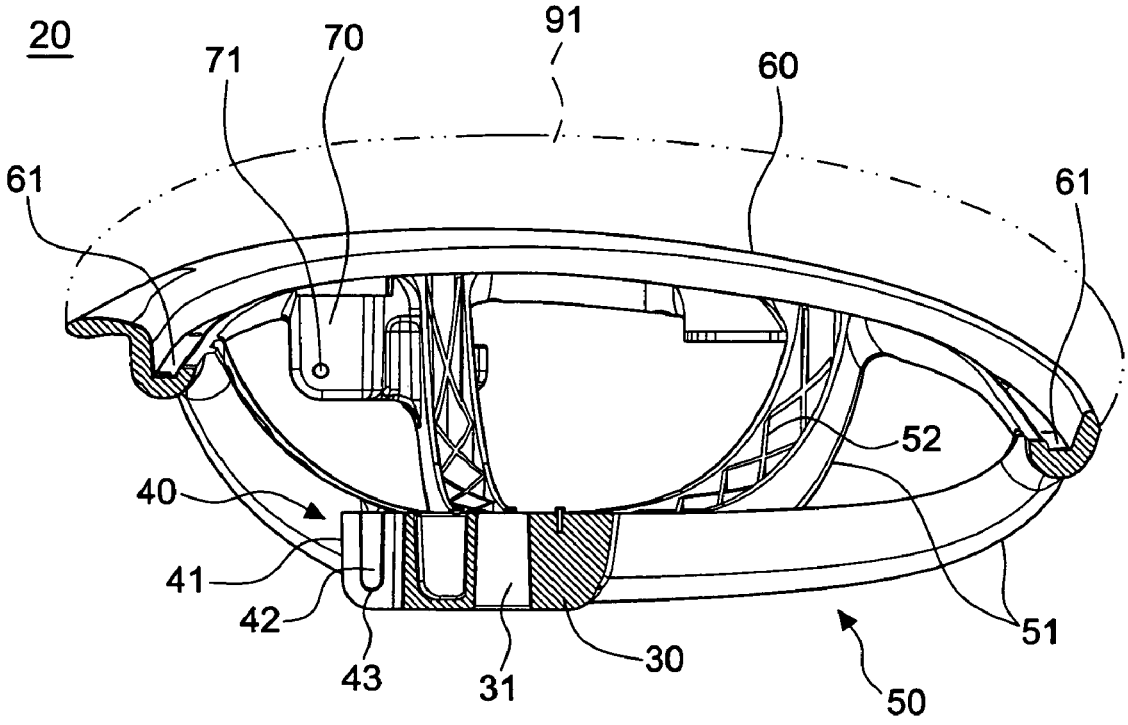
FIG. 6 is a cutaway view taken along the line 6-6 in FIG. 4.
Figure 6A:
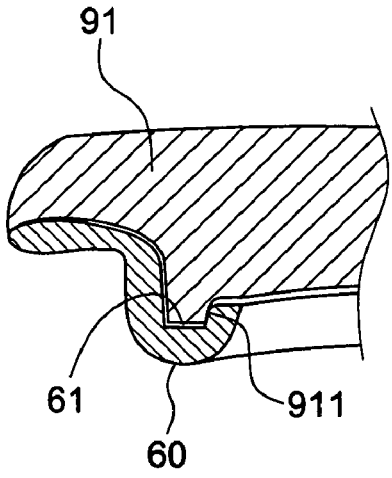
FIG. 6A is a partially enlarged view of the invention in FIG. 6, showing the connection with a seat pad.

Referring further to FIG. 6A, a seat pad 91 of the office chair 90 is mounted on the surface of the base frame 60 by means that a flange 911 at the bottom of the seat pad 91 fits into the annular groove 61. In other words, the annular groove 61 is provided for a rapid and practical placement of the seat pad 91 on the base frame 60.

Figure 5:
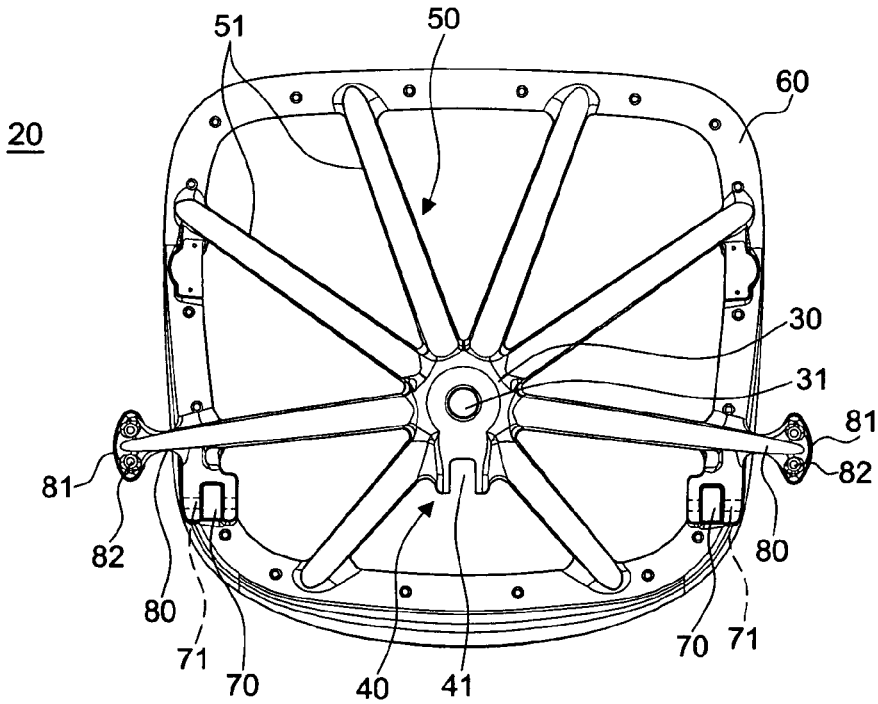
FIG. 5 is a bottom view of a base arrangement of an office chair in accordance with the invention.

Referring further to FIGS. 5, 6, and 9, the second U-shaped pivotal seat 70 is provided for the connection of a connection rod 941 at the bottom of a seat back 94 of the office chair 90. Meanwhile, a locking element fits into the through hole 71 in such a manner that the end portion of the connection rod 941 is brought into a position of pivotal connection.

Figure 3:
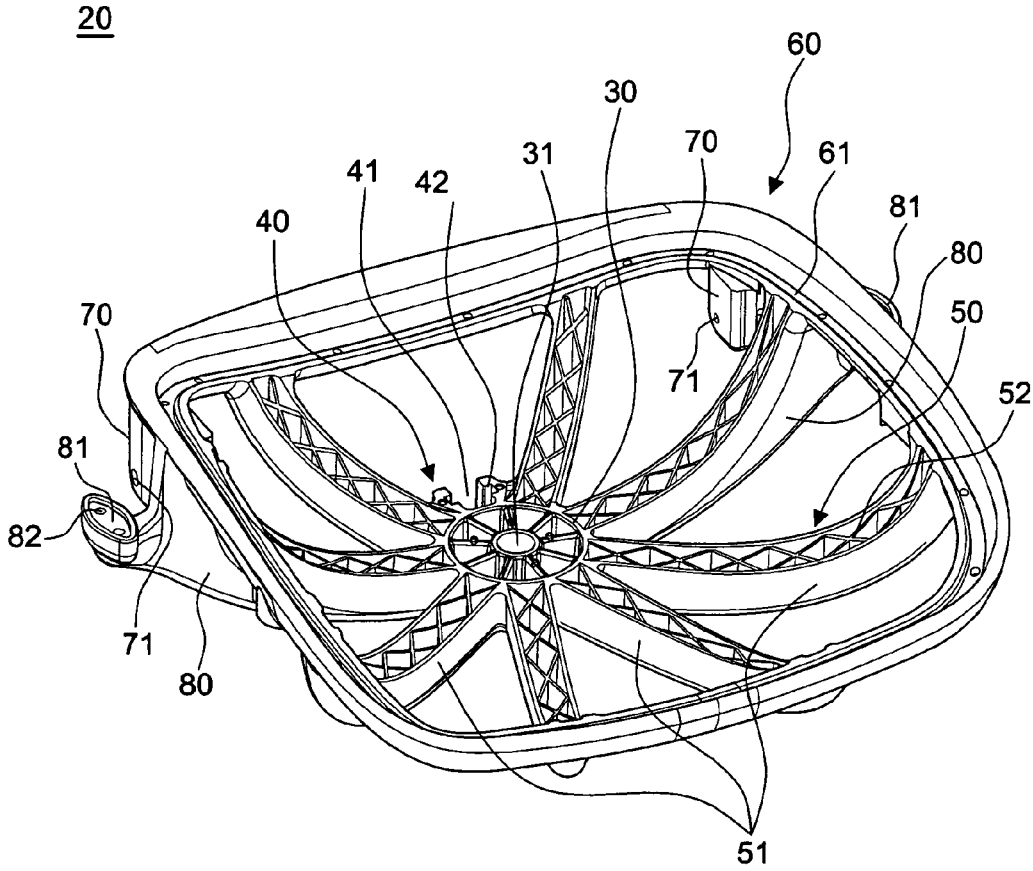
FIG. 3 is a perspective view of a base arrangement of an office chair in accordance with the invention.
Figure 4:
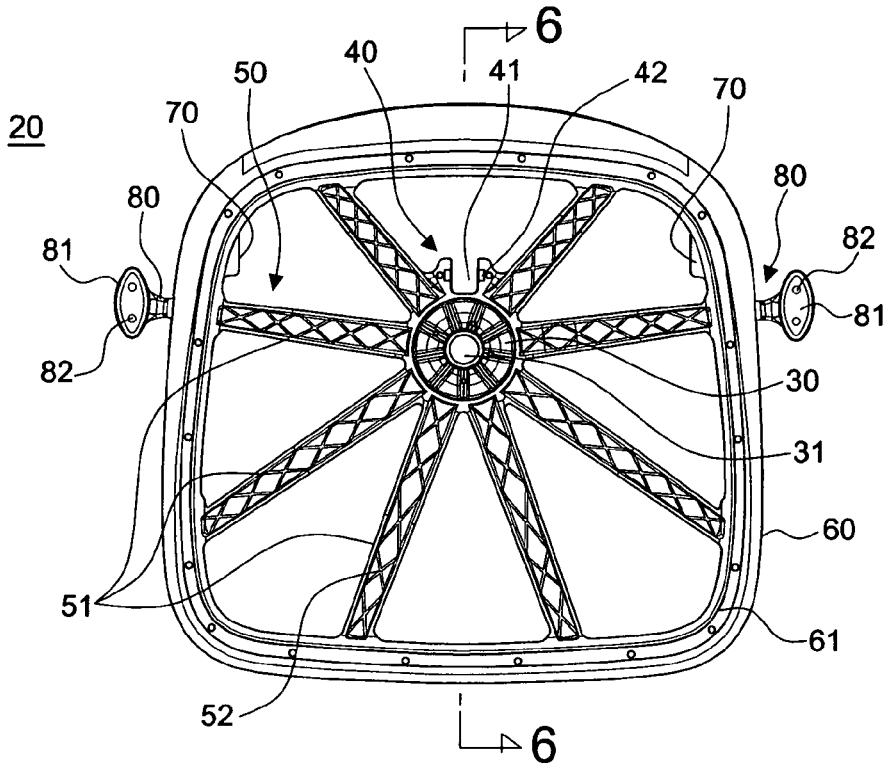
FIG. 4 is a top view of a base arrangement of an office chair in accordance with the invention.

As shown in FIGS. 3, 8, and 9, the connection surface 81 of the hand rest support 80 is provided with positioning holes 82 for the attachment of hand rests 92 to the connection surface 81. The hand rest 92 belongs to the prior art and is not the object of the invention so that no further descriptions thereto are given hereinafter.

According to the invention, the base arrangement 20 is integrally formed and features a rapid connection with the all components of the office chair 90. Moreover, it has an excellent structural strength with lightweight advantage.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An integrally formed base arrangement of an office chair integrally made by plastic material, comprising:

a) a middle axle seat having a conic axle hole in a longitudinal direction;

b) a first U-shaped seat perpendicular to the middle axle seat, the first U-shaped seat having an opening directed aback, the first U-shaped seat being provided with longitudinal grooves at both internal walls thereof, a locating portion being formed at a bottom of the longitudinal grooves;

c) a claw member having a plurality of arched supporting arms extending in angularly spaced manner from an external rim of the middle axle seat upward;

d) a base frame disposed at a top of the supporting arms of the claw member, an annular groove being positioned at a surface of the base frame;

e) two second U-shaped seats symmetrically formed at both sides of a bottom of the base frame with openings directed aback and positioned parallel to the first U-shaped seat, each of the second U-shaped seats having a through hole extended laterally therein; and f) two hand rest supports extended from both sides of the base frame and the claw member outward, thereby creating a connection surface directed upward at an external end thereof.

2. The integrally formed base arrangement of an office chair as recited in claim 1 wherein the axle hole of the middle axle seat is provided for the insertion of a foot seat middle tube therein.

3. The integrally formed base arrangement of an office chair as recited in claim 1 wherein the first U-shaped pivotal seat is provided for the connection of a bottom of an elasticity adjuster of the office chair, and wherein a lateral projection at the bottom of the elasticity adjuster is supported by the locating portion at the bottom of the longitudinal grooves in a pivotal manner.

4. The integrally formed base arrangement of an office chair as recited in claim 1 wherein a seat pad of the office chair is mounted on a surface of the base frame, and a flange at a bottom of the seat pad fits into the annular groove.

5. The integrally formed base arrangement of an office chair as recited in claim 1 wherein each of the second U-shaped pivotal seats is provided for the connection of a connection rod at a bottom of a seat back of the office chair, and wherein a locking element fits into the through hole in such a manner that an end portion of the connection rod is brought into a position of pivotal connection.

6. The integrally formed base arrangement of an office chair as recited in claim 1 wherein the connection surface of the hand rest support is provided with positioning holes for the attachment of hand rests to the connection surface.

* * * * *